US005310036A

United States Patent [19]

Hell

[11] Patent Number: 5,310,036

[45] Date of Patent: May 10, 1994

[54] METHOD FOR CHECKING THE CORRECT PROCESSING OF BANK NOTES

[75] Inventor: Wilhelm Hell, Mering, Fed. Rep. of Germany

[73] Assignee: GAO Gesellschaft fur Automation und Organisation mbH, Munich, Fed. Rep. of Germany

[21] Appl. No.: 44,119

[22] Filed: Apr. 8, 1993

Related U.S. Application Data

[63] Continuation of Ser. No. 690,779, Apr. 26, 1991, abandoned.

[30] Foreign Application Priority Data

Apr. 27, 1990 [DE] Fed. Rep. of Germany ..... 4013585

[51] Int. Cl.[5] ..... G07D 7/00; B07C 5/34; B42D 15/10

[52] U.S. Cl. ..... 194/206; 209/534; 209/551; 283/73; 283/901; 194/208

[58] Field of Search ..... 194/205, 206, 207, 208; 209/534, 546, 551; 283/57, 59, 73, 901

[56] References Cited

U.S. PATENT DOCUMENTS

| | | | |
|---|---|---|---|
| 3,635,321 | 1/1972 | Frazier, Sr. | 194/207 |
| 4,009,892 | 3/1977 | Nickerson, III | 283/901 X |
| 4,023,011 | 5/1977 | Nakajima et al. | 194/207 X |
| 4,253,016 | 2/1981 | Hirose | 194/207 X |
| 4,694,963 | 9/1987 | Takesako | 209/534 |
| 4,725,079 | 2/1988 | Koza et al. | 283/73 |
| 4,787,518 | 11/1988 | Yuge et al. | 209/551 X |
| 4,825,378 | 4/1989 | Yuge | 209/534 X |
| 4,905,840 | 3/1990 | Yuge et al. | 209/534 |
| 5,012,932 | 5/1991 | Omura et al. | 209/534 |

FOREIGN PATENT DOCUMENTS

| | | | |
|---|---|---|---|
| 2760269 | 1/1979 | Fed. Rep. of Germany . | |
| 2088832 | 6/1982 | United Kingdom | 209/534 |

OTHER PUBLICATIONS

"Toshiba Currency Note Arranger", Toshiba Review, No. 130 Nov.-Dec. 1980.

*Primary Examiner*—Michael S. Huppert
*Assistant Examiner*—Scott L. Lowe
*Attorney, Agent, or Firm*—Stevens, Davis, Miller & Mosher

[57] ABSTRACT

The invention relates to a method for checking the correct processing of bank notes in automatic bank note sorters for sorting certain amounts of money into different categories according to given criteria, whereby partial amounts are destroyed if necessary, and a log is prepared, after a given amount of money has been processed or after a certain unit of time, to record information about the processed bank notes, among other things, and the log additionally contains at least one authenticity marking calculated from given log data and clearly related to the data included in the calculation.

19 Claims, 1 Drawing Sheet

METHOD FOR CHECKING THE CORRECT PROCESSING OF BANK NOTES

This application is a continuation of application Ser. No. 07/690,779, filed Apr. 26, 1991, now abandoned.

BACKGROUND OF THE INVENTION

1. Field of the Invention

The present invention relates to a method for checking the correct processing of bank notes in automatic bank note sorters for sorting certain amounts of money into different categories according to given criteria, whereby partial amounts are destroyed if necessary, and a log is prepared, after a given amount of money has been processed or after a certain unit of time, to record information about the processed bank notes, among other things.

2. Description of the Prior Art

Machines have been used for sorting bank notes for some time that single-out, automatically or manually, supplied bank notes, guide them successively through a sensor system, and sort them into different categories according to given criteria depending on the task at hand and the sensor result.

Such a machine is known for example from German patent no. 27 60 269. An essential task of these known sorting machines is to sort bank notes flowing back from circulation into those fit for further circulation and those that are unfit. Bank notes are sorted into a third category if they are suspected to be counterfeits or are unidentifiable or unsortable for other reasons. The notes identified for unfit for further circulation must be reliably destroyed, which can be done, for example, by passing the notes through a shredder module integrated in the sorting machine, that cuts each note into such small shreds that no notes can be restored therefrom.

Money processing on the level of the sorting machine can be roughly divided into three steps. The operator of the machine is given a certain money volume at the beginning of his shift, which he acknowledges receiving. The received amount of money is supplied to the machine and sorted into the stated categories, for example. At the end of his shift the operator turns over the sorted amounts of money, together with a printout logging all relevant operations, to an institution that continues the money processing.

As described in detail in German "offenlegungsschrift" no. 27 60 269, the sorting machine is provided with a printing means for printing out a so-called shift log, among other things. This log records, along with other data, the sums of the bank notes deposited in the intended categories. The sum of all partial amounts in the categories must correspond to the money volume supplied to the machine and acknowledged by the operator. The log data fundamentally permits a check of the individual amounts of money by a recount, for example, so that no bank note can disappear undetected. However, this simple form of check is no longer possible in the case of destroyed notes, so that particularly these notes require a different form of security check to ensure against possible manipulation.

SUMMARY OF THE INVENTION

The invention is therefore based on the problem of ensuring maximum protection against manipulation when using an automatic bank note sorting machine having integrated switching means.

The essence of the invention is to use a cryptographic process to calculate a value from the log data to be protected that is printed out on the log extract one or more times. This calculation can only be conducted by authorized agencies that have knowledge of the cryptographic process or the secrets included in this process. Any falsification, addition or removal of log data leads to a different authenticity value, which is ascertainable in a simple way during a check.

According to a preferred embodiment of the invention, an authenticity code is calculated to protect the log data and this code recalculated by the same method and checked for identity with the earlier determined one to check the authenticity of the log.

It has been known in telecommunications for some time to form so-called authenticating codes. However, the application of this known method for protecting log data of a bank note sorter offers a technically simple possibility of protecting particularly the data of destroyed notes, whose correct processing cannot be readily checked, very effectively against manipulation. The method can of course also be used effectively in sorting means without a shredder function to ensure the authenticity of the prepared logs.

According to a development of the invention, time-variable log data are included in the calculation of the authenticity marking to permit clear differentiation between logs with the same or similar sorting results.

The calculation of the authenticating code is conducted before each log-out in a corresponding security module of the sorter. Depending on the stipulated organizational guidelines one or more logs are provided per shift or processing period with the corresponding authenticity codes, which can also be stored in the machine. Stored authenticity codes can be rechecked for control purposes the following day or even later.

BRIEF DESCRIPTION OF THE DRAWINGS

Further advantages and developments of the invention can be found in the subclaims and the subsequent description of an embodiment example of the invention with reference to the figures, in which:

DESCRIPTION OF THE PREFERRED EMBODIMENT(S)

Figure 1:
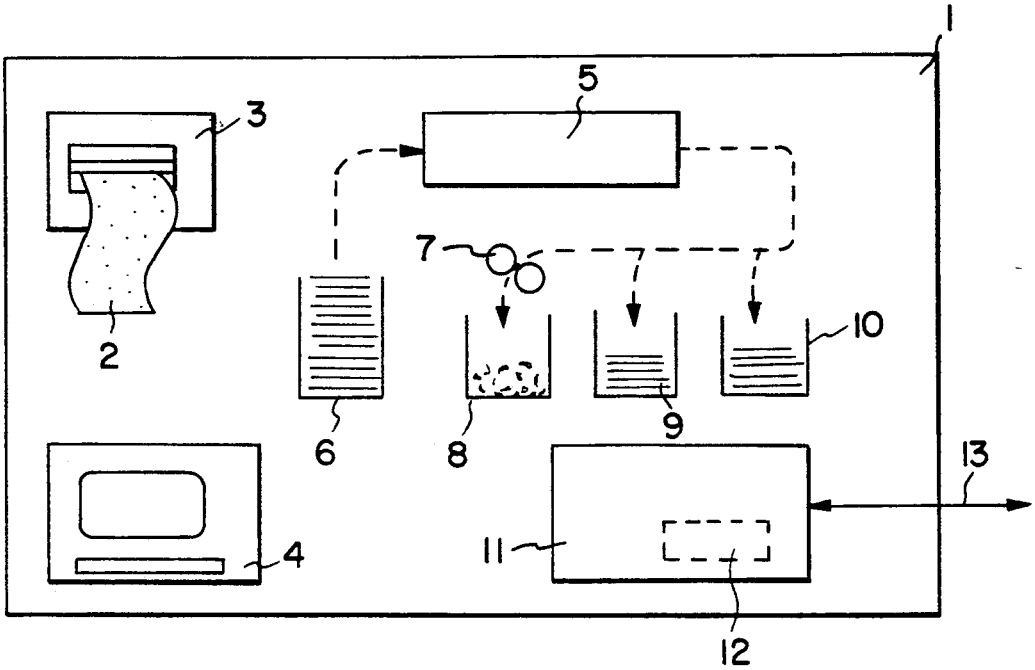
FIG. 1 shows a bank note sorter in a very schematic form.

FIG. 1 shows in very schematic form a possible configuration of a sorter with the essential functional elements.

The bank notes are singled from an input container 6, guided along a sensor path 5 and supplied to different output containers 8, 9 or 10 in accordance with the sensor result. Container 8 collects the bank notes destroyed by a shredder means 7. Container 9 can collect the notes still fit for circulation, and container 10 so-called manual reworking notes. The latter must be carefully rechecked by the operator of the machine since they are suspected to be counterfeits or are unidentifiable, for example. Dialogue with the machine is possible via a console 4. For printing out logs 2 about the money processing, the sorting machine is equipped with a printer 3.

Figure 2:
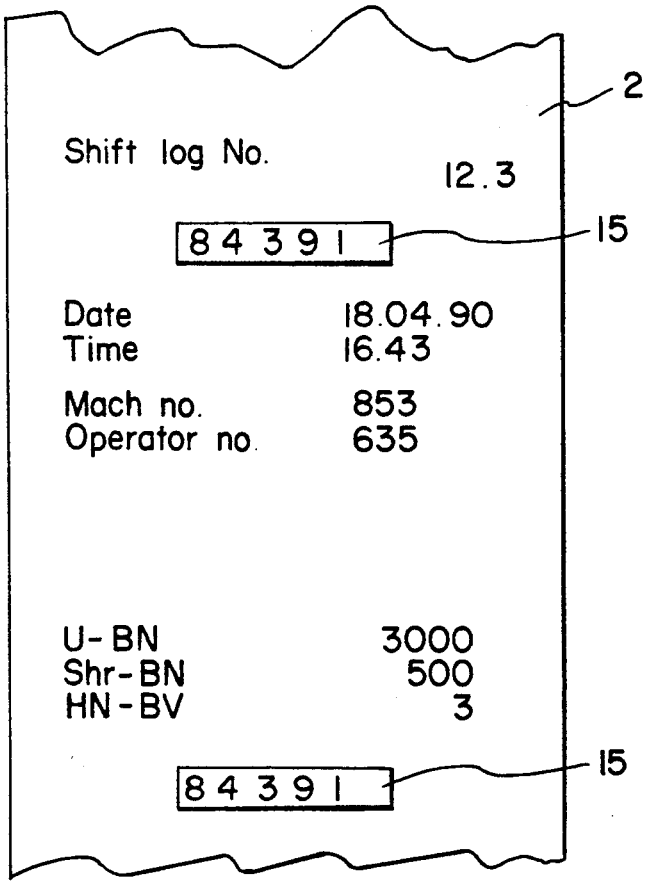
FIG. 2 shows the extract from a log.

An example of such a log is shown in FIG. 2. Depending on the organizational requirements, various types of logs can be printed out, which need not be discussed in any detail here.

FIG. 2 shows a so-called shift log that an operator has printed out after a certain money volume has been worked off. This log is turned over to an institution for processing the money further, together with the processed bank notes sorted into the stated categories.

The log can record the date and time as well as the machine number or the operator's I.D. number. The log also shows the sums of the bank notes deposited in the different categories (fit for circulation ("U") and manual reworking ("HN")) and the destroyed notes ("Shr"). The aforesaid information is only a selection from possible log data. In addition to this information, the log is now provided according to the invention with an authenticity marking 15, that is calculated from all, or a certain selection of, the log data by a cryptographic process. The process will preferably include those data which are to be protected against falsification. In any case the authenticity marking is clearly related to the included data. Any change, addition or deletion of data results in a different authenticity marking, so that any manipulation of the log data is discovered immediately.

The authenticity marking can be calculated in a security module 12 of control and processing unit 11 of the sorter. This module contains the algorithm or secret code for calculating the marking. The module must therefore be protected appropriately against unauthorized access. The calculation of the authenticity marking should include time-variable quantities, such as the date or the time of day or other values meeting this purpose, so that every log is a unicate. The authenticity marking can be printed on the log several times, for example before and after the actual log data, as shown in FIG. 2.

The authenticity of the log can be tested using any device that has security module 12 implemented in the sorting machine and is loaded with the corresponding algorithm or code. The data included in the calculation of the authenticity marking, such as the sums of "U", "HN" and "Shr" notes, are inputted manually via a keyboard of the device. The security module calculates from this input the authenticity marking and shows it on a display, so that the operator can compare the displayed marking with the marking printed on the log. An identity of the two ensures that the checked log data are unfalsified. Despite the simplicity of both the preparation of the authenticity marking and the check thereof, the inventive method achieves a high degree of security as far as the correct processing of bank notes in automatic bank note sorters is concerned. The check can also be conducted on the shredder machine itself after a special operating mode has been selected via control console 4. The result is displayed on the screen of the console. A separate verification device having at least security module 12 and a control console 4 has been omitted from the drawing for the sake of clarity.

The authenticity marking of the log data can also be checked with the aid of a terminal connected with sorting machine 1 via interface 13. The necessary data are transmitted to the terminal, from which the authenticity code is calculated, as described above, in a corresponding security module of the terminal.

The authenticity markings of several logs can be filed in a memory of the sorting machine, for example under the log number or other suitable data, so that old logs can still be checked at a later time.

I claim:

1. A method for checking correct processing of bank notes in an automatic bank note sorter, comprising:

introducing bank notes into said bank note sorter;

sorting said bank notes into categories;

preparing and printing a log report in accordance with said log data, including calculating, generating and printing an encrypted authenticity marking on said log report, said authenticity marking being related to said log data by an algorithm.

2. The method of claim 1, including printing out the authenticity marking at the beginning and at the end of the log report.

3. The method of claim 1, wherein the calculation of the authenticity marking includes a time-variable parameter.

4. The method of claim 1, wherein the log report is prepared after a predetermined amount of bank notes has been processed.

5. The method of claim 1, wherein the log report is prepared after the sorter has been sorting a predetermined unit of time.

6. The method of claim 1, further including;

inputting the log data contained in the log manually into a calculating means independent of the bank note sorter, recalculating the authenticity marking using the calculating means, and comparing the recalculated authenticity marking of the calculating means with the authenticity marking printed on the log report.

7. A method for checking the correct processing of bank notes in automatic bank note sorters, comprising:

introducing bank notes into a bank note sorter, processing by sorting said bank notes into categories, preparing and printing a log containing information about results of the processing of the bank notes, calculating at least one authenticity marking based upon the information contained in said log, storing said at least one authenticity marking in said bank note sorter, and printing said at least one authenticity marking on said log so that the information contained int he log may be verified by recalculating the authenticity marking.

8. The method of claim 7, including printing out the authenticity marking at the beginning and at the end of the log.

9. The method of claim 7, wherein the log is prepared after a predetermined amount of bank notes has been processed.

10. The method of claim 7, wherein the log is prepared after the sorter has been processing a predetermined unit of time.

11. The method of claim 7, wherein the information used in the calculating of the authenticity marking includes a time-variable parameter.

12. The method of claim 7, wherein the calculating of the authenticity marking is performed in accordance with a secret cryptographic algorithm, and wherein the calculating of the authenticity marking takes place in a security module of the bank note sorter.

13. The method of claim 7, further including;

inputting the information contained in the log manually into a calculating means independent of the bank note sorter, recalculating the authenticity marking using the calculating means, and comparing the recalculated authenticity marking of the calculating means with the authenticity marking printed on the log.

14. A method for checking the correct processing of bank notes in automatic bank note sorters, comprising:

introducing bank notes into a bank note sorter, processing by sorting said bank notes into categories, preparing and printing a log containing information about results of the processing of the bank notes, calculating at least one authenticity marking based upon the information contained in said log, printing said at least one authenticity marking on said log so that the information contained int he log may be verified by recalculating the authenticity marking, supplying the information contained in the log, via an interface of the bank note sorter, to a unit connected to the bank note sorter, automatically recalculating the authenticity marking using the unit, and comparing the recalculated authenticity marking of the calculating means with the authenticity marking printed on the log.

15. The method of claim 14, including printing the authenticity marking at the beginning and at the end of the log.

16. The method of claim 14, wherein the log is prepared after a predetermined amount of bank notes has been processed.

17. The method of claim 14, wherein the log is prepared after the sorter has been processing a predetermined unit of time.

18. The method of claim 14, wherein the information used in the calculating of the authenticity marking includes a time-variable parameter.

19. The method of claim 14, wherein the calculating of the authenticity marking is performed in accordance with a secret cryptographic algorithm, and wherein the calculating of the authenticity marking takes place in a security module of the bank note sorter.

* * * * *